US009556674B2

(12) United States Patent
Baglin

(10) Patent No.: US 9,556,674 B2
(45) Date of Patent: Jan. 31, 2017

(54) ROOF ACCESS ARRANGEMENTS

(75) Inventor: Neil Ernest Baglin, Bedfordshire (GB)

(73) Assignee: EASI-DEC ACCESS SYSTEMS LIMITED, West Midlands (GB)

( * ) Notice: Subject to any disclaimer, the term of this patent is extended or adjusted under 35 U.S.C. 154(b) by 8 days.

(21) Appl. No.: 14/005,997

(22) PCT Filed: Mar. 22, 2012

(86) PCT No.: PCT/GB2012/000268

§ 371 (c)(1),
(2), (4) Date: Sep. 18, 2013

(87) PCT Pub. No.: WO2012/127192

PCT Pub. Date: Sep. 27, 2012

(65) Prior Publication Data

US 2014/0008150 A1 Jan. 9, 2014

(30) Foreign Application Priority Data

Mar. 22, 2011 (GB) ..... 1104813.9

(51) Int. Cl.
*E06C 1/34* (2006.01)
*E06C 7/48* (2006.01)

(52) U.S. Cl.
CPC ..... *E06C 1/345* (2013.01); *E06C 7/488* (2013.01)

(58) Field of Classification Search
CPC ..... E06C 1/04; E06C 1/345; E06C 1/36; E06C 7/06; E06C 7/188; E06C 7/48; E06C 7/488; E06C 5/18; E06C 5/22; E04G 3/36
See application file for complete search history.

(56) References Cited

U.S. PATENT DOCUMENTS 1,160,721 A * 11/1915 kessler ..... E06C 1/345 182/163
1,423,998 A * 7/1922 Camp ..... E04G 3/34 182/150
1,470,489 A * 10/1923 Schuh ..... E06C 1/345 182/206

(Continued)

FOREIGN PATENT DOCUMENTS

CA 2494860 A1 * 7/2005 ..... E04D 15/00
DE 83 22 073 U1 12/1983

(Continued)

OTHER PUBLICATIONS

International Search Report, dated Jul. 3, 2012, from corresponding PCT application.

(Continued)

*Primary Examiner* — Alvin Chin-Shue
*Assistant Examiner* — Candace L Bradford
(74) *Attorney, Agent, or Firm* — Young & Thompson

(57) ABSTRACT

A roof ladder construction includes a roof hook assembly and a ladder to which the roof hook assembly is pivotally mountable for movement between two operative positions, a first of the operative positions being a position in which the roof hook assembly may extend over a roof ridge for engagement with a remote roof surface at a side of the roof opposite that at which the ladder is positioned and the other, second position being one in which the roof hook assembly does not engage with the remote surface of the roof.

12 Claims, 3 Drawing Sheets

(56) References Cited

U.S. PATENT DOCUMENTS

| | | | | | |
|---|---|---|---|---|---|
| 1,519,025 | A * | 12/1924 | Fairfield | E06C 7/48 | 182/214 |
| 2,426,825 | A * | 9/1947 | Geary | E04G 3/26 | 182/147 |
| 2,608,879 | A | 10/1950 | Megel et al. | | |
| 2,628,011 | A * | 2/1953 | Buechler | E06C 1/345 | 182/164 |
| 4,179,011 | A | 12/1979 | Morawski | | |
| 4,678,060 | A * | 7/1987 | Pugliese | E06C 1/383 | 182/160 |
| 4,938,312 | A * | 7/1990 | Trail | E06C 7/488 | 182/206 |
| 4,972,922 | A | 11/1990 | Levine | | |
| 5,180,031 | A | 1/1993 | Smith | | |
| 5,601,154 | A * | 2/1997 | Eisenmenger | E04D 15/00 | 182/206 |
| 6,092,624 | A * | 7/2000 | Slater | E04D 15/00 | 182/206 |
| 6,244,381 | B1 * | 6/2001 | Ruble | B66B 9/187 | 182/103 |
| 7,424,932 | B1 * | 9/2008 | Murphy | E06C 1/345 | 182/103 |
| 7,546,902 | B2 * | 6/2009 | Schwertner | B66B 9/193 | 182/103 |
| 8,596,414 | B1 * | 12/2013 | Lown | E04G 3/265 | 182/45 |
| 2006/0054399 | A1 * | 3/2006 | Dudschus | E06C 1/345 | 182/214 |
| 2012/0080263 | A1 * | 4/2012 | Lee | E06C 1/12 | 182/8 |

FOREIGN PATENT DOCUMENTS

| | | | | | |
|---|---|---|---|---|---|
| DE | 3719403 | A1 * | 12/1987 | E04G 1/20 | |
| DE | EP 0341563 | A2 * | 11/1989 | B66B 9/16 | |
| EP | 2 020 481 | A1 | 2/2009 | | |
| FR | 2 163 210 | A5 | 7/1973 | | |
| FR | 2 823 237 | A1 | 10/2002 | | |
| GB | 2 181 477 | A | 4/1987 | | |
| GB | 2358214 | A * | 7/2001 | E06C 1/12 | |
| GB | 2 409 230 | A | 6/2005 | | |
| GB | 2409230 | A * | 6/2005 | E06C 1/345 | |
| GB | WO 2005093201 | A1 * | 10/2005 | E06C 1/34 | |
| GB | 2420819 | A * | 6/2006 | E06C 7/12 | |
| GB | 2 456 630 | A | 7/2009 | | |
| WO | WO 2005093201 | A1 * | 10/2005 | E06C 7/48 | |

OTHER PUBLICATIONS

GB Search Report, dated Jul. 10, 2012, from corresponding GB application.

* cited by examiner

ROOF ACCESS ARRANGEMENTS

BACKGROUND OF THE INVENTION

Field of the Invention

This invention relates to arrangements for facilitating access to the roof regions of a building.

In particular the present invention is concerned with facilitating access to the roof of a building such as a residential house, an office building, or other buildings having what is known as single pitched or double pitched roof constructions.

As is well known the upper most length part of such a roof is known as the ridge.

In the case of a double pitched roof construction the roof to either side of the roof ridge extends downwardly and outwardly away from the ridge which is usually located midway between the walls of the associated building and are in line with the length of the building. In the case of a single pitched roof the ridge is usually located above the wall that is in line with the length direction of the ridge.

For the purposes of the following discussion it will be presumed that the arrangement for facilitating access to the roof is particularly intended to facilitate access to a double pitched roof.

It is convenient to note that with a view to facilitating reduction in the amount of fossil fuels used for producing electrical power it is known to produce electrical power by harnessing the energy of the sun. This power production can be direct as is possible with the use of photovoltaic cells or indirectly by concentrating solar power upon a heatable material that when heated enables production of electrical power. For example one such method involves appropriately focussing the sun's energy so that the focused energy is able to boil water which is then used to provide the desired power.

Description of the Related Art

Generally speaking in relation to buildings such as above mentioned it has been proposed to mount directly upon the roofs of such buildings electricity generating/producing units incorporating an array of photovoltaic cells. These units are generally known as solar panels and are usually mounted upon a roof at location(s) at which it would be able to receive and react to sunlight over as long as possible period during a day.

A solar panels are generally incorporates a shallow rectangular shallow tray like container within which is located a rectangular array of individual photovoltaic cells appropriately electrically interconnected to the output of the panel. A protective sheet of transparent glass/plastics covers in the cells.

As will be appreciated by reason of their extended area rectangular shape, the shallowness of the panels and the fact that they are covered in with sheet glass/plastics the panels need to be very carefully handled during fitting to a roof and whenever it is desired to carry out servicing operation upon fitted panels.

BRIEF SUMMARY OF THE INVENTION

It is an object of the present invention to provide means for facilitating the handling and/or servicing of solar panels located upon or to be located upon a roof and also in relation to other activities upon a pitched roof.

Broadly according to a first aspect of the invention there is provided a roof ladder construction to which a roof hook assembly is pivotally mountable for movement between a roof ridge engaging position and a position in which it does not engage with the ridge, wherein the movement of the roof hook assembly between said positions is remotely controllable.

In a preferred construction the roof hook assembly is retained in either of its operative positions by a resiliently loaded member that is displaceable from a distance.

Preferably, the resiliently loaded member when mounted to one end of the ladder is connected to a cord that is accessible from the other end of the ladder.

Conveniently, the cord is operationally routed through one of the styles of the ladder construction Conveniently the resiliently loaded member is a pin displaceable in a locking direction by the resiliently loading thereof, and displaceable against its resilient loading by said cord.

In a preferred arrangement means are provided for locking the cord against displacement whereby the resiliently loaded member can be retained in its non-engaging position.

In accordance with a further aspect of the invention the ladder construction is provided with means for remotely adjusting the operational position of a roof lock assembly with respect to a ladder upon which it is selectively mountable.

In a preferred construction the means for remotely adjusting the position of the roof lock assembly includes a flexible connection with the roof lock assembly connected at one end with the assembly a storage drum for the flexible connection housed within a style of the ladder.

BRIEF DESCRIPTION OF THE DRAWINGS

For a better understanding of the invention and to show how to carry the same into effect reference will now be made to the accompanying drawings in which:—

DETAILED DESCRIPTION OF THE PREFERRED EMBODIMENTS

Figure 1:
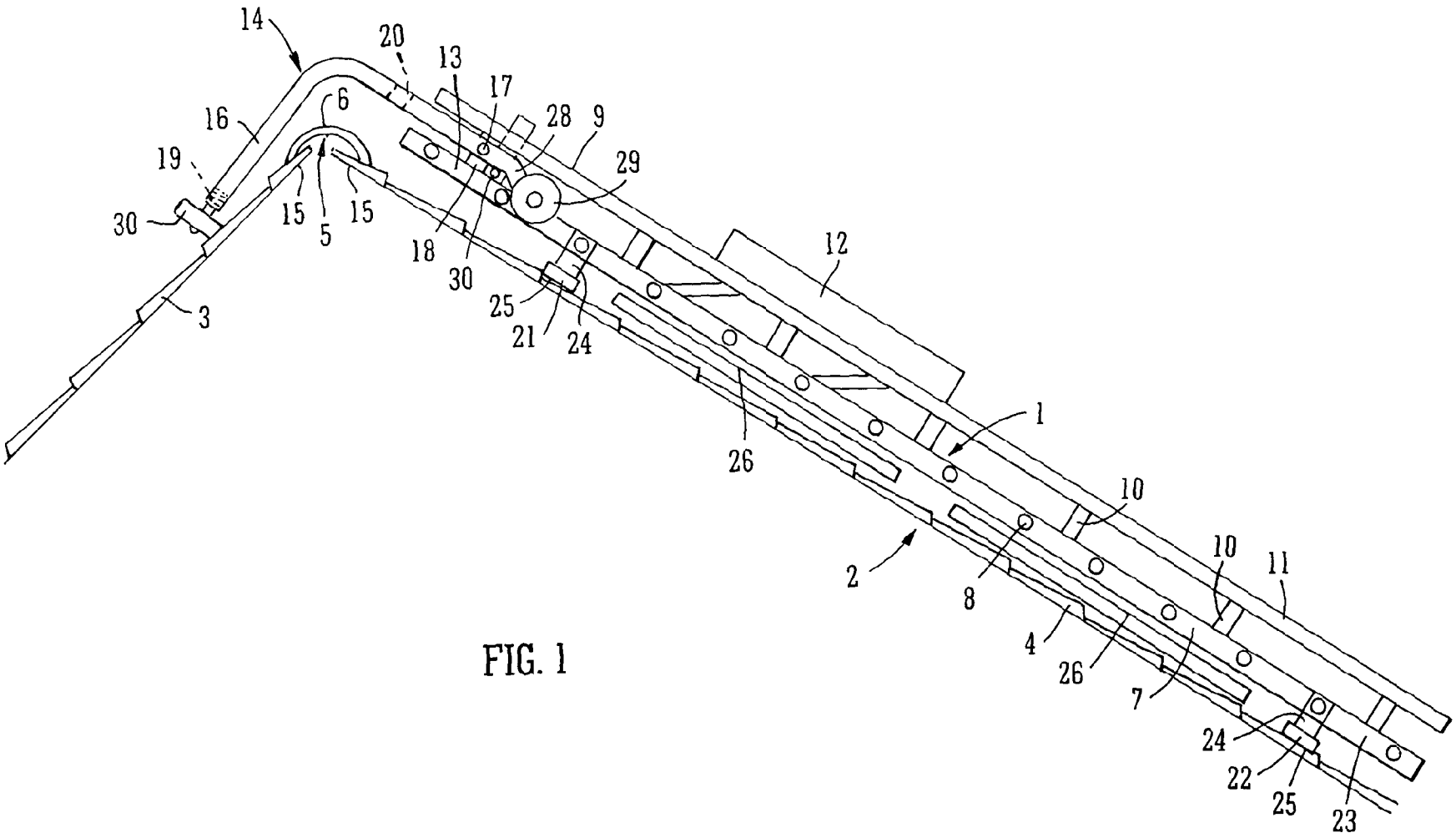
FIG. 1 is a side view of a roof ladder construction incorporating the concepts of the invention when located in its position of use upon a pitched roof.
Figure 2:
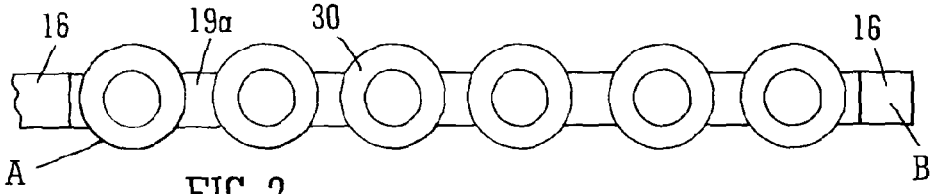
FIG. 2 schematically illustrates to a larger scale a detail of the construction of FIG. 1.

Referring now to FIG. 1 which illustrates in side view a ladder 1 when resting upon one side 2 of a pitched roof including tiled roof sides 3 and 4 and a ridge 5 formed by ridge tiles 6.

The ladder 1 incorporates styles 7 which are of a hollow rectangular cross section that are maintained in spaced parallel arrangement by a plurality of rungs 8.

A side rail 9 extending for the full length of the ladder 1 is provided above each style 7. Each side rail 9 is supported from the associated style 7 by a series of support bars 10.

The upper surfaces 11 of the side rails 9 effectively combine to provide a guide track for a rectangular trolley 12 hereinafter whereby the trolley 12 is able to travel lengthways of the side rails 9 and thus the ladder 1.

Since in use the ladder 1 is required to be advanced upwardly of a pitched roof for example, the roof side 4 and to be retainable in its position on the roof the leading end 13 of the ladder 1 is provided with a so-called roof hook assembly 14 that when in its operative position, as shown in the FIG. 1, bridges the ridge tiles 6 at the upper ends 15 of the two sides 3,4 of the double pitch roof as shown in the Figure locatingly to engage with the other side 3 of the double pitched roof thereby to retain the ladder 1 in a position such as shown in the FIG. 1.

In practice, the roof hook assembly 14 has a dual purpose in that in addition to retaining the ladder in its roof engaging setting it is also arranged to facilitate the displacement of the ladder 1 up or down a roof side.

The roof hook assembly is releasably attachable to the leading end of the ladder includes two generally L-shaped members 16 pivotally connectable one to each side of the ladder 1 by a pivot arrangement 17 engaging with a stub bar 18 upstanding from the associated style 7.

The members 16 are maintained in spaced side-by-side spaced relationship by a cross bar 19 interconnecting the free ends thereof remote from the pivoted regions and an intermediate cross bar 20 located at the bend of the L shape.

The undersides of the ladder styles 7 are supported away from contact with the adjacent roof side tiles by two support battens 21, 22, one 21 adjacent the leading end 23 of the ladder and the other 22 adjacent to the lower end 23 of the ladder.

The support battens 21,22 are connected to the ladder styles by stub bars 24 which are connectable to the ladder styles by way of retractable resiliently loaded locating pins (not shown) engageable in the hollow rungs 8 of the ladder 1. The undersides of the battens 21,22 are provided with cushioning strips 25. By this arrangement the battens 21, 22 can be connected to any selected rung of the ladder and thus positioned at any desired position along the length of the ladder.

With this arrangement when the ladder 1 rests upon the roof sides 3, 4 the only contact between the ladder and the adjacent roof side is between the battens 21, 22 and the adjacent roof tiles. In other words the styles 7 of the ladder are always supported out of contact with the adjacent roof side. In addition, the lengths of the stub bars 24 plus the depth of the battens 21,22 provides for the solar panels 26 a clearance space 27 above any solar panel that may be mounted to the roof.

An important factor arising from the provision of the rails 9 is that these rails in conjunction with the hollow rectangular profiling of the ladder styli 7 is that the combination of the rails and the styli so stiffen the ladder that when the weight of an operator is imposed upon the ladder the latter does not downwardly deform the body of the ladder extending between the battens sufficiently to damage any solar panel 26 that may be located beneath the ladder installation when supported by the battens 21,22.

In order to enable the ladder to be advanced upwardly of a roof side the free ends 28 of the ridge assembly bars 16 that are adjacent to the region of pivoting of the assembly are downwardly deformed as is shown in the FIG. 1 and are provided with soft surface roof tile running wheels 29 that are such that when the wheels 29 are in engagement with a roof side 3/4 the leading end 13 of the ladder is raised upwards and held away from contact with the adjacent roof side thereby enabling the ladder leading end 13 to be advanced upwards of the roof side towards the ridge 6. In addition the main body of the ladder is raised away from the roof side.

A plurality of wheels 30, for example six, are mounted upon a cross bar 19A such that these wheels can rotate about axes transverse to the length direction of the ladder, the cross bar 19A being so pivotally connectable to the cross bar 19 that the inclination of the wheels 30 may be set at an angle to the bar 19 that is appropriate to the pitch inclination of the roof side 3 upon which the wheels 30 are required to run.

With this arrangement on lifting the lower ladder end 23 away from contact with a roof side the ladder is effectively lifted away from contact with the adjacent roof side 4 at which stage the ladder is readily moveable lengthways of the roof.

At the time it is required to mount the ladder assembly onto a pitched roof the assembly 14 is moved to a position in which the wheels 29 rest upon the adjacent roof side so that the wheels 29 will run on this roof side. When the wheels 29 are in engagement with a roof side 3,4 the leading end 13 of the ladder is lifted away from contact with the roof, this being the setting shown in FIG. 1. As will be noted the wheels 29 have effectively been moved lie closely adjacent to the ladder styles 7.

When the wheels 29 are in contact with the roof the leading end 13 of the ladder 1 is lifted sufficiently above the adjacent roof side that the upper batten 21 is raised away from contact with the roof to a distance such that it is raised above level of any solar panel 26 mounted to the roof or sufficiently high to allow an adequate clearance 27 beneath the upper batten for any solar panel to be mounted to the roof.

Figure 3:
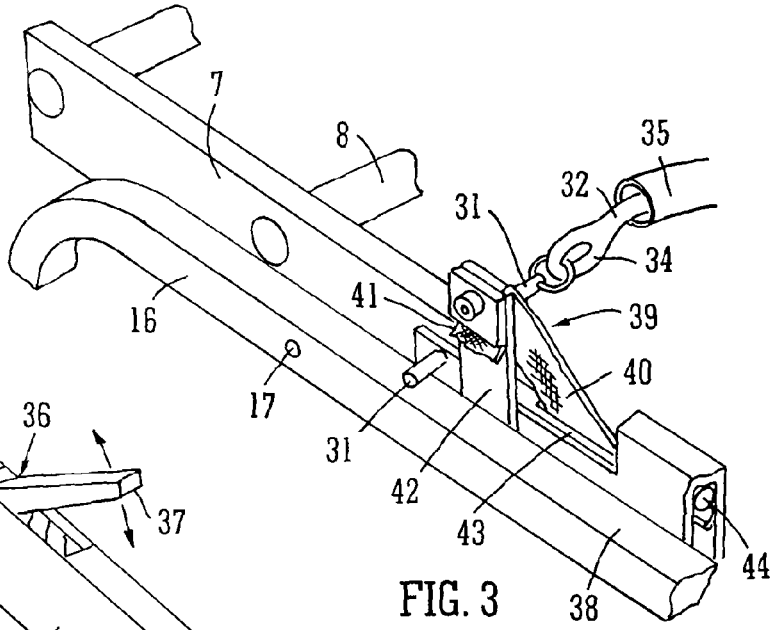
FIG. 3 schematically illustrates to a larger scale further details of the Apparatus illustrated in FIG. 1, FIG. 4 schematically illustrates to a larger scale further details associated with the details shown in FIG. 3.

The assembly is held in either of its two operational settings by means of a resiliently loaded locking pin 31 mounted for axial displacement in one of the ladder styles 7. FIG. 3 schematically illustrates the positioning of the locking pin 31 relative to a ladder style.

The pin 31 is so positioned that when the roof hook assembly 14 is in the position shown in FIG. 1 the pin 31 is in engagement with the underside of the assembly member 16*l* thereby to hold the member in the position shown i.e., with the wheels 30 in their raised positions out of contact with the adjacent roof side 3,4.

When the roof hook assembly 14 is in its alternative position in which the wheels 30 are able to roll upon the adjacent roof side 3 the pin 31 is in contact with the opposite side of the assembly member 16 thereby holding the member in such position that the wheels 29 are maintained in contact with the adjacent roof side 4 thereby to hold the hook assembly in its raised setting so that it is sufficiently raised to allow the wheels 30 freely to pass over the ridge tiles 6. When in this position the leading end 13 of the ladder is also correspondingly raised sufficiently to lift the upper batten 21 out of contact with the adjacent roof side 4 whereby the leading end 13 of the ladder is supported solely by the wheels 29.

It will be apparent that the movement of the roof hook assembly 14 from one position to the other involves positioning of the resiliently loaded pin 31.

In practice it is necessary to be able to raise or lower the roof hook assembly from one operational position to the other without a person being present on the ladder 1 it is arranged that the movement of the pin 31 between its operational settings is remotely operable from the lower end of the ladder assembly.

For this purpose the pin 31 is connected at the end thereof that is remote from the end that engages with the assembly member 16 to a cord 32 that is accessible from the lower end 23 of the ladder.

Figure 4:
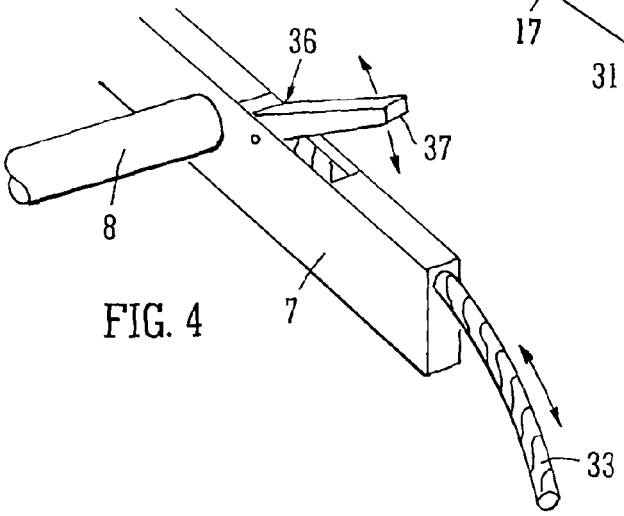

This cord 32 is located internally of one of the styles 7 and is of such length that it hangs from the lower end of the ladder style to thus provide a pull cord portion 33 (FIG. 4) at the lowermost end of the style within which it is located.

The other end 34 of the cord 32 connects with the pin 31. To ensure that any pull exerted by the cord is axially directed of the locking pin 31 the end of the cord connecting with the pin passes through a curved tube 35 that bridges the space between the ladder styles.

The cord 31 is lockable against movement by means of a so called cord clutch 36 (schematically illustrated in FIG. 4) mounted to the cord containing style near the lower most end thereof. The cord clutch 36 incorporates an operating lever 37 having a cord engaging position (closed position) in which it prevents movement of the cord 32 within its associated style and thus the resiliently loaded locking pin 31 relative to the associated ladder style and thus the assembly member 16 with which it cooperates and a cord release position (open position indicated in FIG. 4) in which it allows the cord 32 to move lengthways of the associated style on exerting pull on the cord pull portion 33 to displace the pin 31 against its resilient loading and also on ceasing pull on the cord end to allow the pin 31 to return to its resiliently loaded setting in engagement with the assembly member 16.

In use to release the locking pin 31 the clutch 36 is opened and pull is exerted upon the cord 32 to withdraw the locking pin. As mentioned above the locking pin can be retained in its withdrawn position by closure of the cord clutch 36 by means of the operating lever 37.

The manner of raising and the lowering of the assembly 14 relative to the body of the ladder will now be considered.

Referring now to FIG. 1 it will be noted that the roof hook assembly 14 is in the position in which the wheels 29 have been raised so that the weight of the leading end of the ladder and the roof hook assembly are being carried by the engagement of the upper ladder batten 21 with the adjacent roof side 4. In addition, it is useful to note that the assembly members 16 extend beyond the leading end 13 of the ladder and that the portions of the members 16 between their pivots 17 and the section thereof carrying the wheels 29 may be regarded as being generally in line with the styles of the ladder.

When in this position of the roof hook assembly 14 the resiliently loaded pin 31 engages with the upper surface 38 of the assembly member 16 (FIGS. 1 and 3) thereby to retain the member 16 in the position shown in the FIGS. 1 and 3. This positioning of the resiliently loaded pin 31 in conjunction with the engagement of the wheels 30 results in the roof hook assembly 14 being firmly held in the position shown.

As has been mentioned the positioning of the roof hook assembly is required to be remotely controllable.

Thus the ladder installation is provided with remotely operable means 39 for enabling remote changeover of the position of the roof hook assembly 14 from that shown in FIG. 1 into a position in which the wheels 29 are in rolling contact with the adjacent roof side 4.

This remotely operable means 39 includes a roof hook assembly lifting strap 40 connected at one end 41 thereof to an element 42 upstanding from the ladder style 7 and stiffening bar 9 with which the locking pin 31 is associated.

Figure 5:
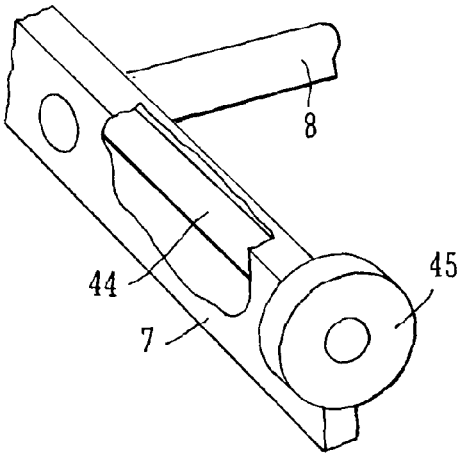
FIG. 5 schematically illustrates to a larger scale a further detail of the construction shown in FIG. 1.

Immediately adjacent to the base of the element 42 a part of the wall of the associated ladder style is cut-away to enable the body of the strap 40 to wrap around a bush 43 (FIG. 3) housed within the style 7 and connected for rotation within the style by a rod 44 (FIG. 5) extending lengthways of the style to connect with a hand rotatable control wheel 45 externally located at the lower end 23 of the ladder.

Figure 6:
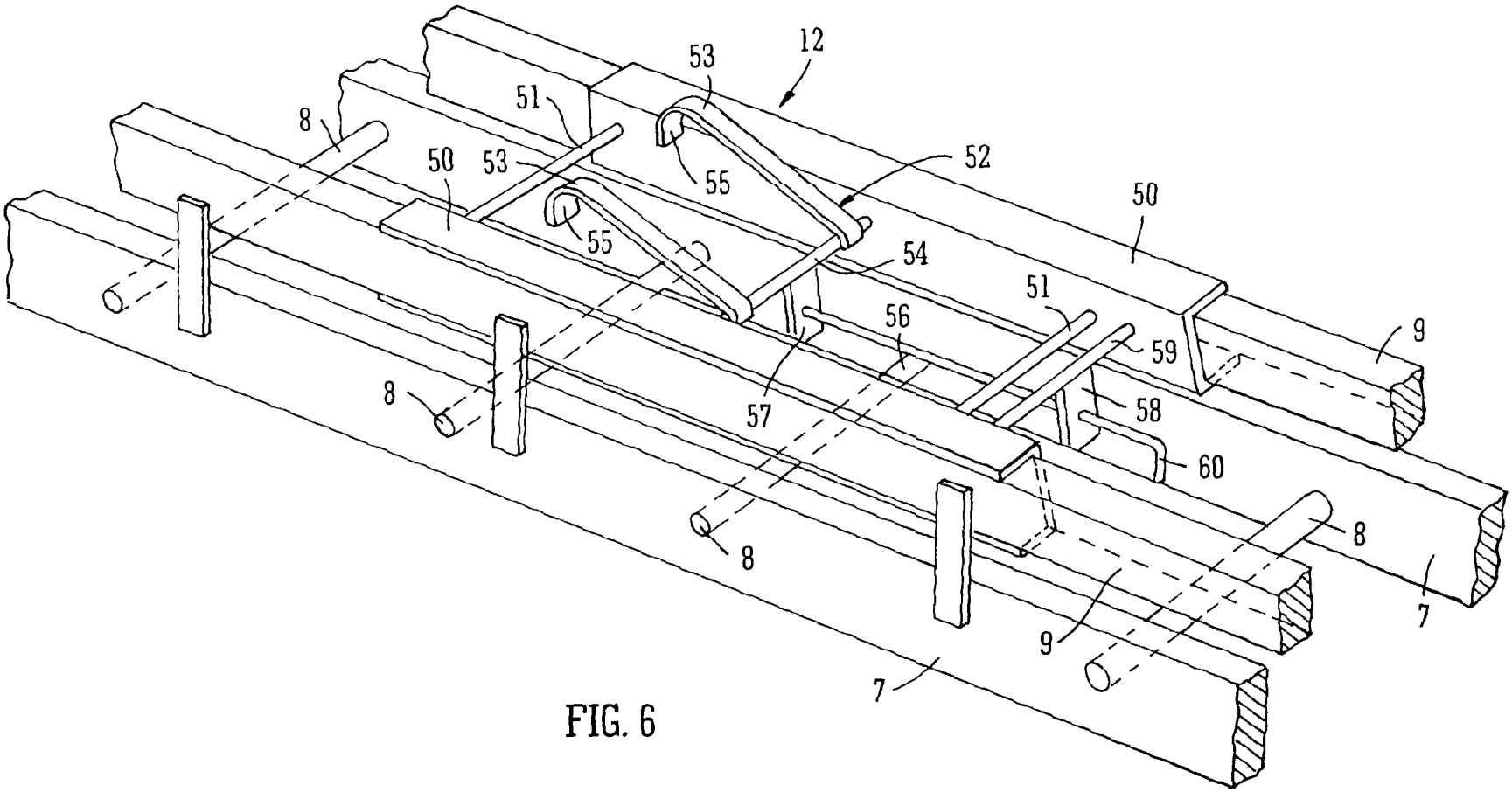
FIG. 6 schematically illustrates a trolley construction.

As has been above mentioned a part of the ladder installation includes a trolley 12 which is movable lengthways of the trolley. A schematic representation of a chassis construction for such a trolley is shown in FIG. 6.

This chassis would be provided with a platform (not shown) upon which an operator can position loads such as solar panels up and down the roof and also operate from a working position on the trolley.

Basically the chassis is intended to be supported upon the side rails 9. In the schematic embodiment shown in FIG. 6 the chassis includes two channel members 50 arranged as illustrated in the FIG. 6 on the side rails 9. These channel members can be arranged merely to slide upon the associated rails 9 or appropriately positioned wheels may be provided.

The members 50 are maintained in spaced apart relationship by cross members 51. In the Figure two such members are illustrated if considered necessary more than two such members can be provided.

Bearing in mind the trolley is required to be movable up or down a sloping roof the trolley is provided with a fail-safe arrangement which when the trolley is being moved lengthways of the trolley has to be held in its release position and which is arranged automatically to engage with the lowermost nearest rung 8 of any latter with which it is associated in the event that an operator ceases for whatever reason to hold the arrangement in the release position.

In the FIG. 6 the arrangement is illustrated as a drop in hook system 52 including two hook members 53 projecting from a cross member 54 pivotally mounted between the channels 50. As will be seen from the Figure the free ends 55 of the members 53 are curved downwards in a hook like shape which enables the ends to engage over ladder rungs 8.

The cross member 54 and thus the members 53 are pivotable relative to the side rails by movement of an operating rod 56 connected at one end to a bracket 57 extending perpendicularly to the cross member 54. The rod extends lengthways of the trolley. The end region of the rod 56 remote from the cross member 54 is supported by a bracket 58 supported from a fixed cross member 59.

The end of the rod adjacent to the bracket 58 is shaped to provide a handle part 60 which enables an operator to push the handle part 60 towards the bracket 59. This action maintains the hook members in their raised disengaged positions. Upon release of such push the members automatically move to their ladder rung engaging positions.

The invention claimed is:

1. A roof ladder construction comprising:

a roof hook assembly;

a ladder to which the roof hook assembly is pivotally mountable for movement between two operative positions, the ladder comprising i) stiles, the stiles each having a hollow rectangular cross section with two opposite side walls, and ii) rungs, the rungs extending through each of the two opposite side walls of each stile, maintaining the stiles in fixed, spaced apart arrangement, a first of said operative positions being a position in which the roof hook assembly may extend over a roof ridge for engagement with a remote roof surface at a side of the roof opposite that at which the ladder is positioned, and a second of said operative positions being another position in which the roof hook assembly does not engage with said remote surface of the roof, wherein movement of the roof hook assembly is remotely controllable, wherein a control member for remote control of movement of the roof hook assembly extends through a hollow portion of one of the stiles, and wherein the control member extends through the one stile from a top end of the one stile adjacent the roof hook assembly to an opposite end of the one stile which is remote from the ladder end region at which the roof hook assembly is pivotally mountable;

a remotely controllable locking element for securing the roof hook assembly relative to the ladder in at least one of the two operative positions; and a remotely extending actuation member, wherein the actuation member extends through an associated stile for remote control of said locking element, wherein the actuation member extends through the associated stile to an end of the stile which is remote from the ladder end region at which the roof hook assembly is pivotally mountable, wherein said actuation member comprises a resiliently loaded member; and resilient bias means to hold the remotely controllable locking element in position to secure the roof hook assembly relative to the ladder in at least one of the two operative positions, wherein the locking element comprises a pin displaceable in a locking direction to a locking position by the resilient bias means and displaceable against the bias means to a non-locking position by the actuation member, and wherein the actuation member comprises i) a cord which extends lengthwise within the associated stile and connects with the pin, and ii) a cord clutch that locks and unlocks movement of the cord, the cord clutch including an operating lever moveable between a cord engaging position in which the cord clutch prevents movement of the cord and a cord release position in which the cord clutch allows the cord to move lengthwise within the associated stile.

2. A roof ladder construction according to claim 1 wherein the pin is mounted for axial displacement in one of the ladder stiles.

3. the roof ladder construction according to claim 1, further comprising:

a trolley;

a pair of side rails extending for a full length of the ladder above each stile and above at least a portion of the roof hook assembly; and a series of support bars that extend from a respective one of the stiles to a respective one of the side rails such that each side rail is supported from the respective one of the stiles by a respective one of the series of the support bars, wherein, upper surfaces of the sides rails provide a guide track for the trolley to travel lengthways of the side rails and the ladder.

4. A roof ladder construction according to claim 1, wherein the roof hook assembly comprises a pair of wheels which engage with the first roof surface when in the second operative position thereby to assist movement of the ladder over the roof surface in a direction parallel with the length of the ladder.

5. A roof ladder construction according to claim 1, wherein the roof hook assembly comprises wheel means which engage with said second roof surface when the roof hook assembly is in the first operative position thereby to assist movement of the roof ladder construction in a direction sideways relative to the length of the ladder.

6. A roof ladder construction according to claim 1, wherein the ladder comprises support spacers to maintain the ladder stiles spaced from a roof surface.

7. A roof ladder construction according to claim 1, wherein, the roof hook assembly is releasably attachable to an end region of the ladder.

8. A roof ladder construction according to claim 1, wherein, the roof hook assembly is non-releasably attached to an end region of the ladder.

9. A roof ladder construction according to claim 1, wherein a rail is secured to the ladder spaced above each ladder stile thereby to stiffen the ladder against deflection in a direction towards the roof surface.

10. A roof ladder construction according to claim 9 wherein each rail provides a guide track for guiding movement of a load carrier along the length of the ladder.

11. A roof ladder construction according to claim 10 in combination with a load carrier movable along said guide track.

12. The combination of claim 11 and comprising fail safe means operable between the ladder and load carrier to restrain uncontrolled movement of the load carrier.

* * * * *